US008446240B2

(12) United States Patent
Swartzentruber et al.

(10) Patent No.: US 8,446,240 B2
(45) Date of Patent: May 21, 2013

(54) SEALED CONTACTOR

(75) Inventors: Brent J. Swartzentruber, Ventura, CA (US); Mike Molyneux, Santa Barbara, CA (US); Daniel C. Sullivan, Santa Barbara, CA (US)

(73) Assignee: Gigavac LLC, Carpenteria, CA (US)

( * ) Notice: Subject to any disclaimer, the term of this patent is extended or adjusted under 35 U.S.C. 154(b) by 0 days.

(21) Appl. No.: 13/090,424

(22) Filed: Apr. 20, 2011

(65) Prior Publication Data

US 2011/0193662 A1 Aug. 11, 2011

Related U.S. Application Data

(63) Continuation of application No. 11/900,504, filed on Sep. 11, 2007, now Pat. No. 7,944,333.

(60) Provisional application No. 60/844,063, filed on Sep. 11, 2006.

(51) Int. Cl.
*H01H 1/66* (2006.01)
*H01H 51/00* (2006.01)

(52) U.S. Cl.
USPC ..... 335/151; 335/202; 335/260; 335/278

(58) Field of Classification Search
USPC ..... 335/202, 260, 274, 278, 292, 151
See application file for complete search history.

(56) References Cited

U.S. PATENT DOCUMENTS 2,749,403 A * 6/1956 Horman et al. ..... 335/126
4,644,179 A * 2/1987 Pointout et al. ..... 335/131

* cited by examiner

*Primary Examiner* — Ramon Barrera
(74) *Attorney, Agent, or Firm* — Koppel, Patrick, Heybl & Philpott

(57) ABSTRACT

A low cost, sealed contactor comprises a hermetically sealed housing with a flat header having internal components for changing the state of said contactor. Terminals are electrically connected to the internal components for connection to internal circuitry and applying an electrical signal to control the state of the contactor. A solenoid-driven plunger with a hollow shaft is included. Power-reducing electronics located within the hermetically sealed housing are also included. Two contact springs are also included to improve electrical performance. O-rings are added to help seal the contactor and keep it hermetically sealed.

7 Claims, 8 Drawing Sheets

FIG. 9
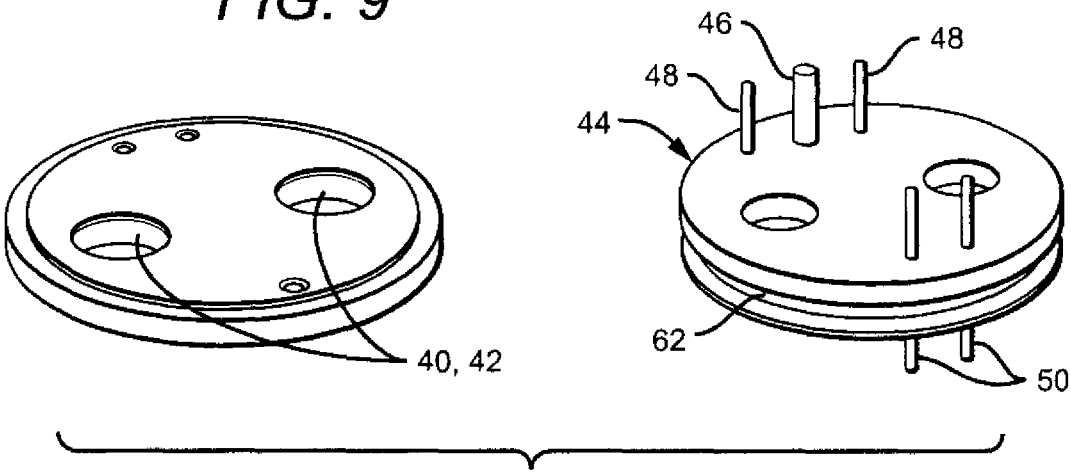
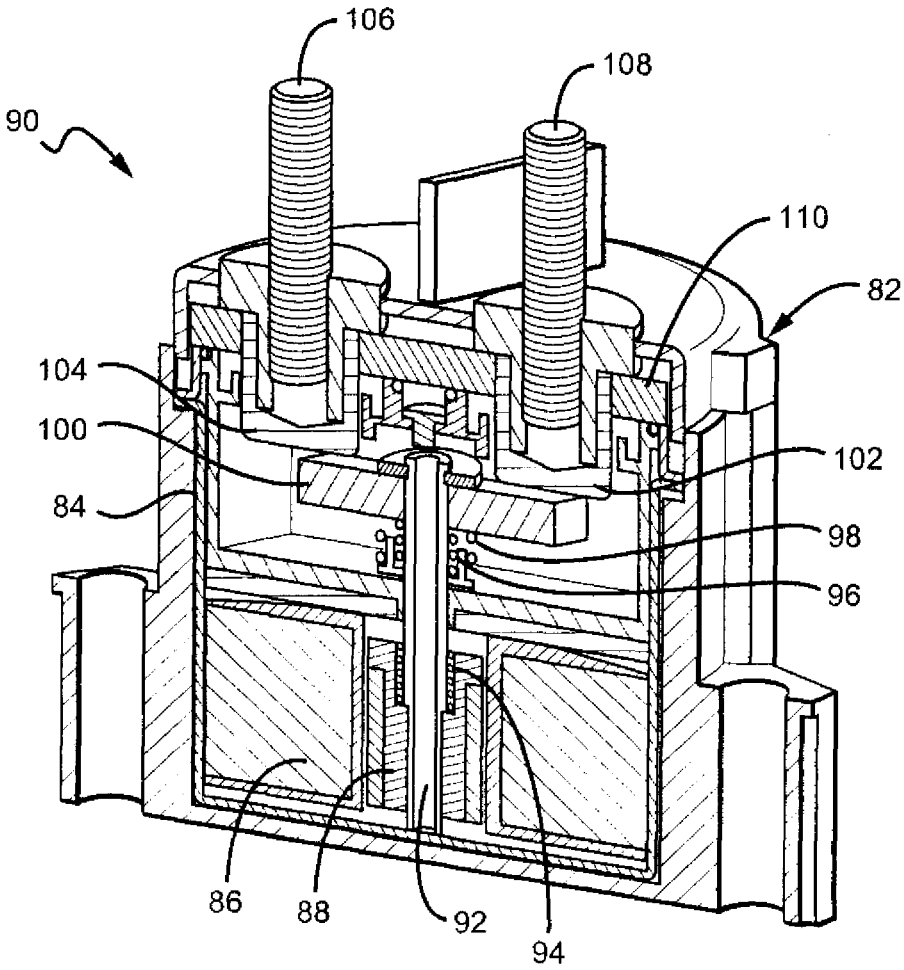
FIG. 11

SEALED CONTACTOR

This application claims is a continuation of, and claims the benefit of, U.S. patent application Ser. No. 11/900,504 to Swartzentruber et. al, filed on Sep. 11, 2007, now U.S. Pat. No. 7,944,333 which claims the benefit of provisional application Ser. No. 60/844,063 to Mike Molyneux et al, which was filed on Sep. 11, 2006.

BACKGROUND OF THE INVENTION

1. Field of the Invention

The present invention relates to sealed contactors, and particularly to low cost sealed contactors in hermetically sealed housings.

2. Description of the Related Art

Hermetically sealed contactors are magnetically-operated devices used for repeatedly establishing and interrupting an electrical power circuit and for switching of high electrical currents and/or high voltages. They typically have fixed and movable internal contacts, and an internal actuating mechanism supported within a hermetically sealed housing. In one type of contactor, air is removed from the contactor housing to create a vacuum that suppresses arc formation, provides long operating life and allows for low resistance operation of the contactor. In another type of contactor, the evacuated chamber can be backfilled under pressure with an insulating gas, which allows the contactor to operate with good arc-suppressing properties.

One type of conventional contactor has moving components housed within a ceramic housing. These types of contactors can operate with a vacuum formed in the housing or with the housing having internal pressure from an injected gas. This allows the contactors to operate with higher voltage and/or lower resistance characteristics and ceramic housings also allow the contactors to operate at high temperature. Ceramic housings, however, can be expensive and difficult to manufacture. Contactors may also comprise a housing with a ceramic header. Ceramic headers offer many of the same voltage, resistance and/or temperature characteristics of ceramic housings as well as offering a means whereby contacts can be electrically isolated from one another. Traditional ceramic headers can be difficult and expensive to manufacture because they are complex shapes that require special tooling, difficult metallization, and time consuming post processes.

Current hermetically sealed contactors also have housings that are complex shapes of ceramic or are epoxy sealed plastic. Epoxy sealed housings can be more prone to failure at high temperature and the all-ceramic envelope products can be very expensive. While the use of flat ceramic can be used, one problem is that the arc chamber is separate from the header. During high current interrupt, arc plasma could reach other metal parts outside the arc chamber if it is not properly sealed. To properly seal the chamber, epoxy or a brazement could be used, however they must be exact solutions dimensionally and can reduce the performance and/or increase the price.

Additionally, conventional contactors have a movable plunger component that is driven by a solenoid in order to move the movable contacts to the stationary contact. Sealed solenoid driven contactors can be problematic due to pressure build-up on one side of the plunger during plunger travel. This imbalance of pressure slows plunger movement and can reduce solenoid performance. To address this, some relays are provided with a bigger gap in the plunger to reduce the magnetic force or they will machine in expensive grooves to allow gas to flow by the outside of the plunger as the plunger moves to the stationary contacts.

Another operating characteristic of conventional contactors is the performance parameter release time, which is how fast the plunger and its movable contactor can open and break from the stationary contacts, thereby breaking the current being carried. To achieve this, strong springs are traditionally used to move the armature when the coil power is removed. Having strong springs requires a large amount of coil power to operate the contactor. The efficiency of the magnetic field increases as the relay operates and as a result the holding power required is much less than the power required to begin operation. The steady state power can be reduced by using a two coil design, one high power coil for operating the relay, and a lower power coil for holding the armature in place after operation. However, traditional two coil designs can be costly and/or can be problematic due to power-reducing components often comprise mechanical switches that are located outside of the contactor. This can expose the components to the hazards of the external environment, which can reduce the efficiency and life of the contactor.

Also, in a typical single pull single throw solenoid plunger contactor, the solenoid moves the moveable contact a certain distance before it makes contact with the stationary contacts. This distance is known as the contact gap, and provides the electrical isolation to stop current flow. The magnetic force from the solenoid has an exponential rise as it approaches the end of its travel. After the moveable contact makes contact with the stationary contact, the plunger continues to move often referred to as overtravel. This overtravel compressing a single contact spring, often referred to as the overtravel spring. The compression force of this spring is applied to the contacts and the greater the spring for the better the electrical performance. However, the spring force can be greater than the solenoid force, which can cause the solenoid actuator to stall as it is moving and fail to close.

U.S. Pat. No. 4,039,984 to DeLucia et al. generally discloses a high-voltage magnetic contactor enclosed within a housing of insulating material which contains a gas, such as sulfur hexafluoride. The terminals within the housing extend through its wall and are secured to and sealed to the housing to prevent gas from leaking from the housing. Leads are connected to the terminals externally of the housing, with insulating material surrounding the leads and being secured by the terminals to the housing. An operating mechanism within the housing shifts a pivoted arm electrically connected to one of the terminals within the housing into and from contact with another of the terminals within the housing. The housing is made from a material that has high impact strength and high heat resistance such as a polyamide or polycarbonate resins.

U.S. Pat. No. 4,168,480 to DeLucia discloses a high voltage magnetic contactor that is enclosed by an insulating housing containing a gas, such as sulfur hexafluoride, under pressure. The switch terminals removably extend through a wall of the housing and are sealed. The magnet contactor structure is removably connected to the housing by a sealed joint. A fill valve extends through a wall of the housing and is sealed to the housing. The armature shifts a pivotal arm in the housing between open and closed contact positions. The housing is formed of a polyamide material that is resistant to deterioration by fluorine gas, the material being poly hexamethylene terephthalic amide.

U.S. Pat. No. 5,554,963 to Johler et al. discloses a contactor that includes a plastic enclosure, contacts disposed in the plastic enclosure for selectively operating to make and/or break at least one electrical connection, a gas filling containing at least one electronegative gas, and a sealed plastic encapsulation for preventing the at least one electronegative gas from diffusing away. The electronegative gases are not utilized at high pressure, but under atmospheric pressure or slightly higher pressure. Since normal pressure is used, a hermetically sealed encapsulation can be dispensed with and the enclosure can be made of low-cost plastics without connection to the outside air.

U.S. Pat. No. 6,265,955 to Molyneux et al. generally discloses a contactor having a primary external sidewall formed by a plastic potting cup with a sealed chamber arranged within the cup and having the contactor's moving components. The cup is enclosed at the bottom by a base, with the base and cup serving as a mold to hold epoxy material poured into the cup and cured to provide a hermetic seal. Insulated electrical leads extend through the epoxy material from the sealed chamber for connection of fixed and movable contacts to external circuitry. The base can have a threaded portion that extends from the underside of cup. The potting cup is preferably formed of Nylon 6/6.

SUMMARY OF THE INVENTION

The present invention provides sealed contactors that are less expensive, easier and more flexible to manufacture, yet still exhibit long life and reliable high voltage operation. One embodiment of a solenoid driven contactor according to the present invention comprises a hermetically sealed housing having internal components for changing the state of said contactor, with the housing comprising a cup for holding the internal components and a header covering said cup with an airtight seal. Terminals are included that are electrically connected to the internal components for connection to circuitry and for applying an electrical signal to control the state of the contactor. Power-reducing electronics are also included and are located inside the hermetically sealed housing.

Another embodiment of solenoid driven contactor according to the present invention comprises a hermetically sealed housing having internal components for changing the state of said contactor, with the housing comprising a cup for holding said internal components and a header covering said cup with an airtight seal. Terminals are included that are electrically connected to said internal components for connection to circuitry and applying an electrical signal to control the state of said contactor. Also, a plunger is included that is movably operated by said solenoid, said plunger having a hollow shaft.

Another embodiment of a high-powered contactor according to the present invention comprises a hermetically sealed housing having internal components for changing the state of said contactor. Terminals are included that are electrically connected to said internal components for connection to circuitry and applying an electrical signal to control the state of said contactor. Additionally, power-reducing electronics are included and located inside said hermetically sealed housing.

These and other further features and advantages of the invention would be apparent to those skilled in the art from the following detailed description, taking together with the accompanying drawings, in which:

BRIEF DESCRIPTION OF THE DRAWINGS

FIG. 9 is a perspective view of a component of a sealed contactor according to the present invention;

FIG. 11 is a perspective view of another embodiment of a sealed contactor according to the present invention.

DETAILED DESCRIPTION OF THE INVENTION

Figure 1:
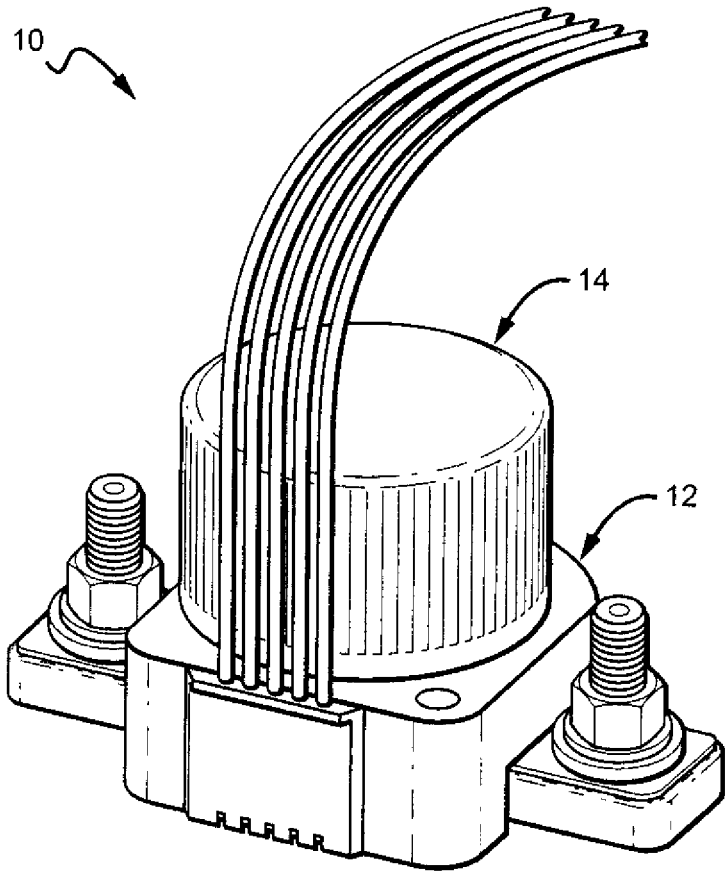
FIG. 1 is a perspective view of one embodiment of a sealed contactor according to the present invention.

The present invention provides a low cost, high-powered, solenoid-driven contactor in a hermetically sealed housing. The housing includes a flat, low cost ceramic header that provides an airtight seal. This allows the header to be manufactured using low cost materials and processes, while still providing a housing that can be gas filled under pressure to provide reliable high voltage operation through a long life cycle. The flat ceramic header also provides for inexpensive tooling, simple metallization and uncomplicated post processes while providing electrical isolation between the contacts.

Inside the housing, a plunger with a hollow shaft is included. Sealed solenoid-driven contactors are known to have pressure build up on one side of the plunger during travel, which can slow plunger movement and reduce performance. The hollow shaft enables improved plunger movement since gas in the sealed housing can flow freely and pressure can equalize during plunger travel.

Also inside the hermetically sealed housing are power-reducing electronics using a two coil design. The steady state power can be reduced by using a two coil design, using one high power coil for operating the contactor, and a low power coil for holding the armature in place after operation begins. The power-reducing electronics of the present invention provide an innovative and unique approach to controlling the operate time of a starting coil in a contactor. Additionally, by miniaturizing the power-reducing electronics and locating them inside the hermetically sealed housing, they become impervious to the hazards of the external environment.

Another component inside the hermetically sealed housing is a second nested contact spring. In order to overcome the possibility of the overtravel spring force being greater than the solenoid force and to take advantage of the magnetic force of the solenoid that rises exponentially as it approaches the end of its travel, a second contact spring is included in the present invention that is activated after the first overtravel spring. The first overtravel spring is preloaded and has a lower spring rate. The second contact spring has a greater spring rate but is not preloaded and is not activated until the solenoid actuator moves a specified amount and its force begins to rise quickly. Therefore, the second contact spring does not cause the solenoid to stall but it increases the force to the contact as the plunger reaches the end of its travel and increases the electrical performance of the contactor.

Other components of the hermetically sealed housing are high temperature O-rings. In order to make an appropriate seal for the arc chamber that can tolerate high temperature applications while being cost effective, high temperature O-rings are added to make an appropriate seal of the arc chamber.

The invention below is described in relation to different embodiments of contactors according to the present invention, but it is understood that the invention can be used with other contactors or devices and that the contactors below can have different components arranged in different ways.

It will be understood that when an element or component is referred to as being "on", "connected to", "coupled to" or "in contact with" another element or component, it can be directly on, connected or coupled to, or in contact with the other element or component or intervening elements or components may be present. In contrast, when an element is referred to as being "directly on," "directly connected to", "directly coupled to" or "directly in contact with" another element or component, there are no intervening elements or components present.

FIGS. 1-7 show one embodiment of a low cost, high-powered contactor 10 according to the present invention comprising a housing 12 having a outer cup 14 and a flat header 16. The contactor's internal moving components can be arranged on the header 16 as further described below and the header 16 is sized and arranged to mate with and mount in the opening of the cup 14 such that there is a hermetic seal between the two. The contactor's internal moving components are held in the sealed internal chamber defined by the header 16 and the cup 14. As further described below, an internal chamber is formed by the cup 14 and header 16 that can be filled with gas by an air tube that passes through the header 16. Alternatively the air tube can be used to form a vacuum within the chamber. The contactor's internal components are also contacted through the header 16. Operation of contactors is generally known in the art and is only briefly discussed with reference to the different components in contactor 10.

FIGS. 2-7 show the contactor's internal components, which include a mechanism for changing the state of the contactor, with a preferred mechanism being a solenoid 18. Many different solenoids can be used, with a suitable solenoid operating under a low voltage and with a relatively high force. One example of suitable solenoid is commercially available solenoid Model No. SD1564 N1200, from Bicron Inc., although many other solenoids can be used. The internal components further comprise a plunger 20, a plunger spring 22, a hollow plunger shaft 24, first and second contact springs 26, 28, solenoid opening 30, circular plate 32, and moveable contact 34. Most of the plunger 20 is arranged within solenoid 18 with a small portion protruding from the solenoid opening 30. The hollow shaft 24 goes through the middle of the plunger 20 with the plunger spring 22 held between the lower portion of the plunger 20 and substantially circular plate 32. When the solenoid 18 is energized, the plunger 20 is drawn fully from the solenoid and the plunger spring 22 is compressed between the lower portion of the plunger 20 and the circular plate 32. When the solenoid is not energized, the plunger is urged by the spring 22 to extend at least partially in the solenoid 18. The hollow plunger shaft 24 enables the plunger 20 to move readily in a sealed environment, as the hollow shaft 24 allows any gas within the sealed housing 12 to flow freely through the plunger 20 and the pressure to equalize during the travel of plunger 20.

Also, when the solenoid 18 is energized, it moves the moveable contact 34 a certain distance known as the contact gap before it makes contact with fixed contacts 36, 38. The contact gap provides the electrical isolation to stop current flow when the movable contact 34 is not in contact with the fixed contacts 36,38. After moveable contact 34 makes contact with fixed contacts 36, 38, the plunger 20 continues to move and compresses first contact spring 26. This additional post-contact movement of the plunger is known in the art as plunger overtravel. The compression force of first contact spring 26 is applied to the contacts through the initial part of the plunger overtravel. As the solenoid approaches the end of its overtravel, its magnetic force rises exponentially. In order to take advantage of the steep force curve of the solenoid, second spring 28 is activated. First contact spring 26 is preloaded and has a lower spring rate, while second contact spring 28 has a greater spring rate but is not preloaded and is not activated until the solenoid 18 moves the plunger 20 an additional distance, with a preferred distance being 0.010. The second contact spring 28 thus does not cause the solenoid 18 to stall but it increases the force of the contacts at the end of the plunger overtravel, which improves the electrical performance of the contactor.

Figure 10:
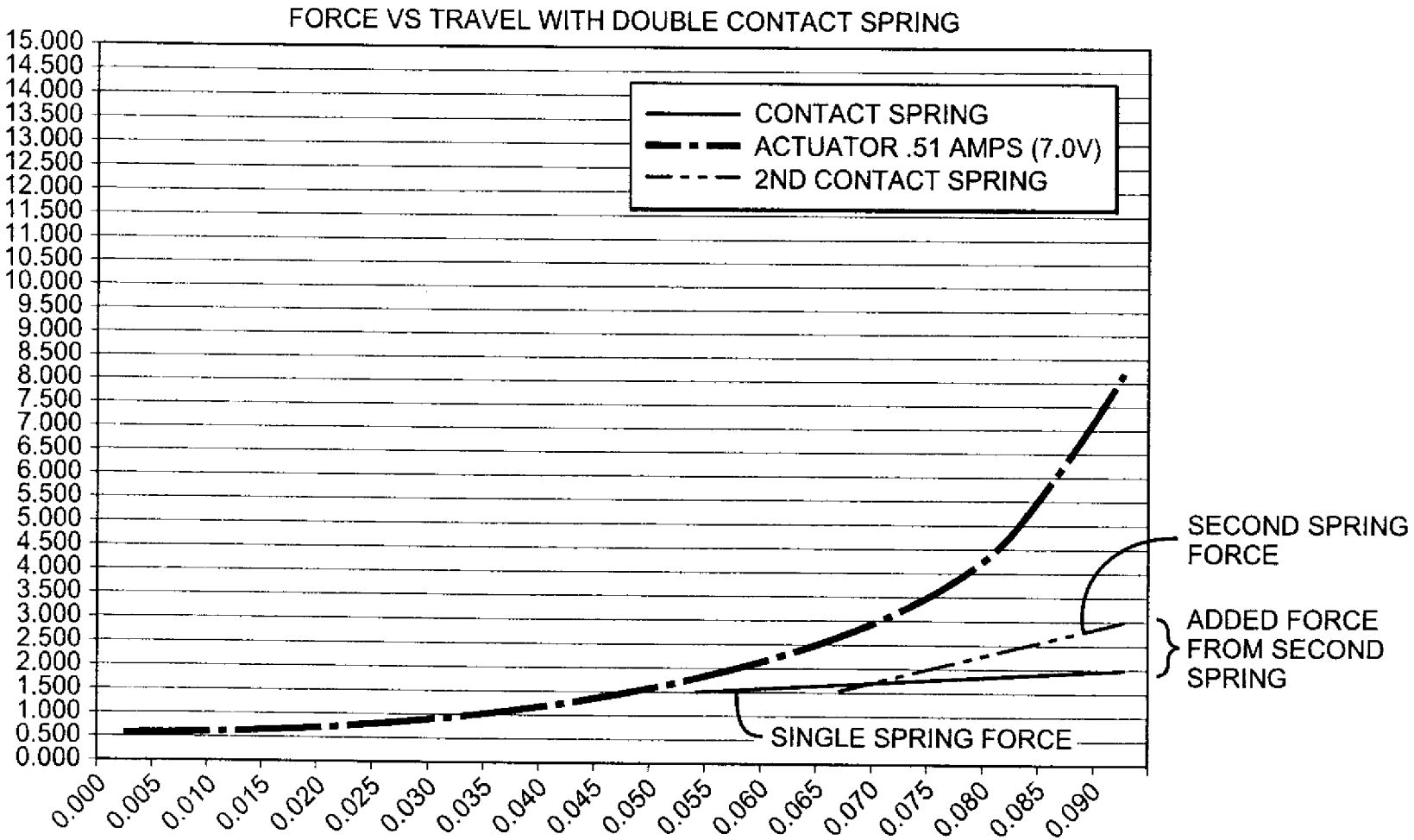
FIG. 10 is a plan view of an embodiment of a contactor according to the present invention.

FIG. 10 illustrates one embodiment of the force of the solenoid versus the travel of first and second contact springs 26, 28. The darker curved, dotted line shows the force from the actuator with the two contact springs 26, 28 acting together, and indicates that the second contact spring 28 adds approximately one pound of contact force, which represents a 50% increase over the first contact spring 26 acting alone.

The dotted while line shows the force from the first contact spring 26 acting alone, where the solid, black line shows the force from the second contact spring 28 acting alone.

The header 16 is a flat shape to help make tooling inexpensive, the metallization simple, and the post processes less complicated. Header 16 is preferably made of ceramic, although other materials resistant to high temperatures may be used. Header 16 comprises first and second contact holes 40, 42 sized so that fixed contacts 36 and 38 can pass through the header 16 to make electrical contact with moveable contact 34. The contact holes 40, 42 and the outer rim of the header coated with an electrically conductive material, with a preferred conductive material comprising a metal such as copper. As best seen in FIG. 9, the header 16 is then formed into a braze assembly 44, with a sealed evacuation tube 46 and sets of vertical members 48 and 50. The evacuation tube 46 is arranged to allow gasses to be injected into the housing, preferably under pressure. In other embodiments, the tube 46 can be used to create a vacuum in the housing 12. After the gasses are injected (or vacuum created) the tube is sealed so that no further gasses can pass in or out. The sets of vertical members 48 and 50 pass through the header 16, with members 48 in contact with auxiliary contacts 52, and members 50 in contact with circuit board 54.

Pursuant to the present invention, the cup 14 and header 16 are preferably made of a material having low or substantially no permeability to the gas injected into the housing, with the cup 14 comprising an inner can core 56 and an outer housing top 58, said can core 56 preferably being made from a metal such as iron, and said outer housing top 58 being made from a low permeability plastic or polymer. The flat header 16 is preferably made from ceramic. Many different gasses can be injected into the housing 12. While many different gases may be used, the preferred injected gas is hydrogen because it protects the copper from oxidation, keeps the contacts clean, and keeps contact resistance low. Many different plastics can be used according to the present invention such as commercially available polyvinyheaderene chloride (PVDC), nylon and polyethylene terephthalete (PET), or ethylene vinyl alcohol (EVOH).

To provide a hermetically sealed housing 12, the inner can core 56 is arranged with a flange 60 around the edge of its opening. The header braze assembly 44 arranged with a complimentary flange 62, and is sized so both flange 60 and 62 can rest on one another. O-rings 64 are included around each of the contact holes 40, 42 to ensure that a hermetic seal is formed at each of the holes through the header 16. The O-rings 64 are preferably suited to high temperature applications, and are used to make an appropriate seal of the arc chamber 66 so that no internal components in the arc chamber 66 can reach other metal parts outside the arc chamber 66. The O-rings 64 have been proven to provide appropriate hermetic seals for tests up to 2000 Amps at 280V, although much higher interrupts are expected.

The solenoid 18 can be energized by applying the appropriate bias to solenoid through coil and auxiliary contact lead wires 80. This caused the movable contact 34 to contact the fixed contacts 36, 38 to form a conductive path between the first and second solenoid terminal studs 68, 70. The terminal studs 68, 70 are located on respective terminal buses 72, 74, and are secured to buses 72, 74 via terminal stud hardware 76. The terminal studs 68, 70 are located externally and to the left and right of the housing 12 in a preferred embodiment, but it is understood that the terminal studs 68, 70 may be arranged in a number of varying embodiments. When the solenoid 18 is not energized the moveable contact 34 is not in contact with the first and second fixed contacts 36, 38 due to the action of the plunger spring 22.

The release time of the contactor is an important performance parameter that is handled by power-reducing electronics. The speed at which a contactor can open and break the current being carried is very important. Strong springs are generally used to move the plunger 20, the moveable contact 34 and the various components of an armature when the coil power of the solenoid 18 is removed. Since the efficiency of the magnetic field increases as the contactor operates, two coils are used to operate the contactor. One high power coil is used for operating the relay, and a low power coil is used for holding the armature in place after operation. One embodiment according to the present invention for controlling the operate time of a starting coil in a relay is known as the Cut Throat Economizer (CTE), though other methods for controlling the operate time may be used.

Figure 8:
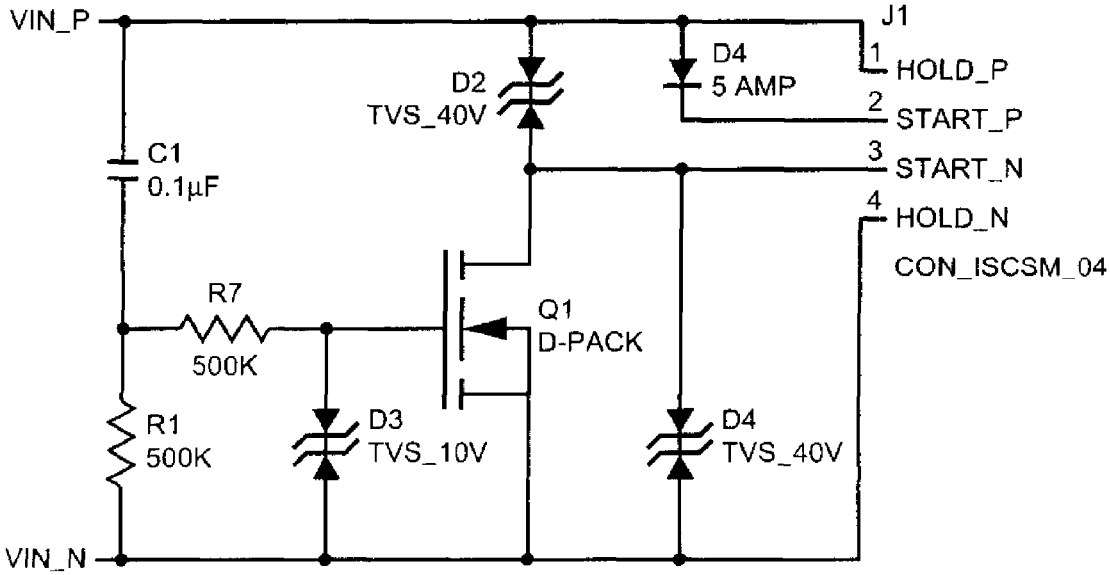
FIG. 8 is a plan view of the contactor in FIG. 1.

FIG. 8 illustrates how CTE works to control the operate time of a starting coil. The starting coil is enabled by transistor Q1 that is preferable a metal oxide semiconductor field effect transistor (MOSFET). The amount of time the Q1 is on is controlled by the resistor-capacitor time constant of R1 and C1. The initial voltage controlling the time constant is always fixed by zener diode D3 independent of supply side or ground side operation. When power is removed, the holding coil develops a flyback voltage which has a recirculation path through the intrinsic diode of Q1 and the starting coil. D1 blocks this and keeps the holding coil current from recirculating at the diode threshold level. Zener D2 controls the flyback voltage level where holding coil current recirculation does occur. Zener D4 limits the drain to source voltage to allow the use of a wider variety of mosfets.

Figure 2:
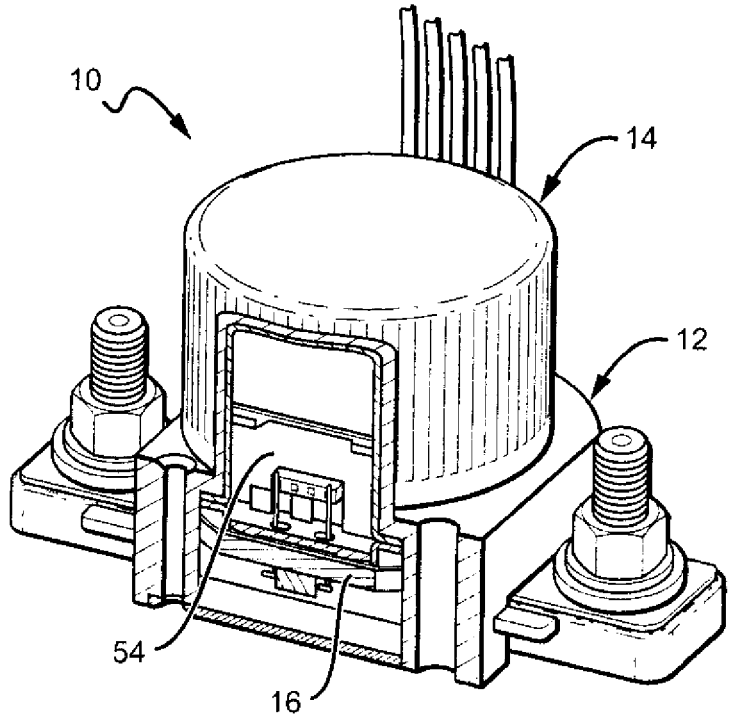
FIG. 2 is a sectional view of the contactor in FIG. 1.
Figure 3:
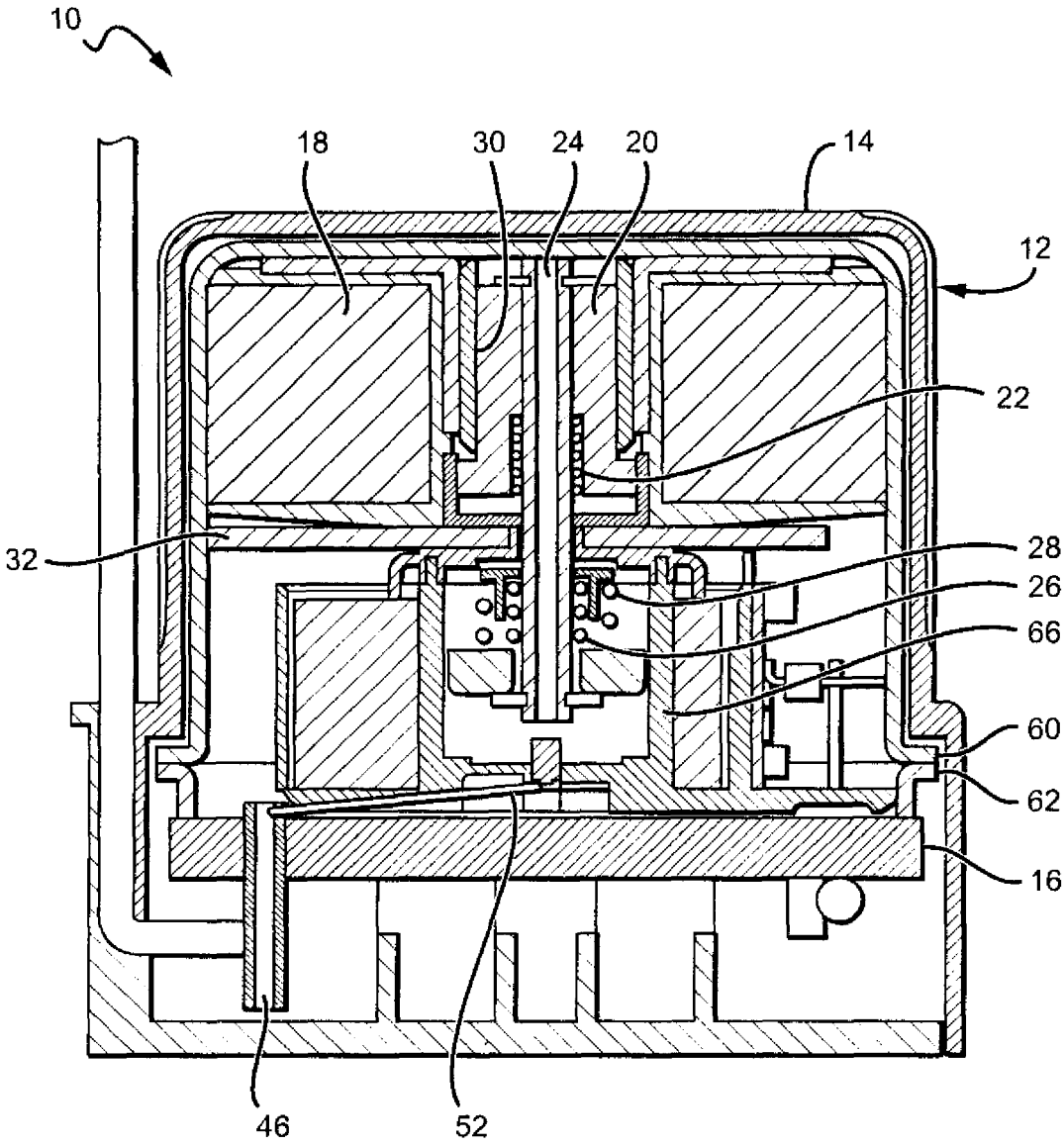
FIG. 3 is a side sectional view of the contactor in FIG. 1.
Figure 4:
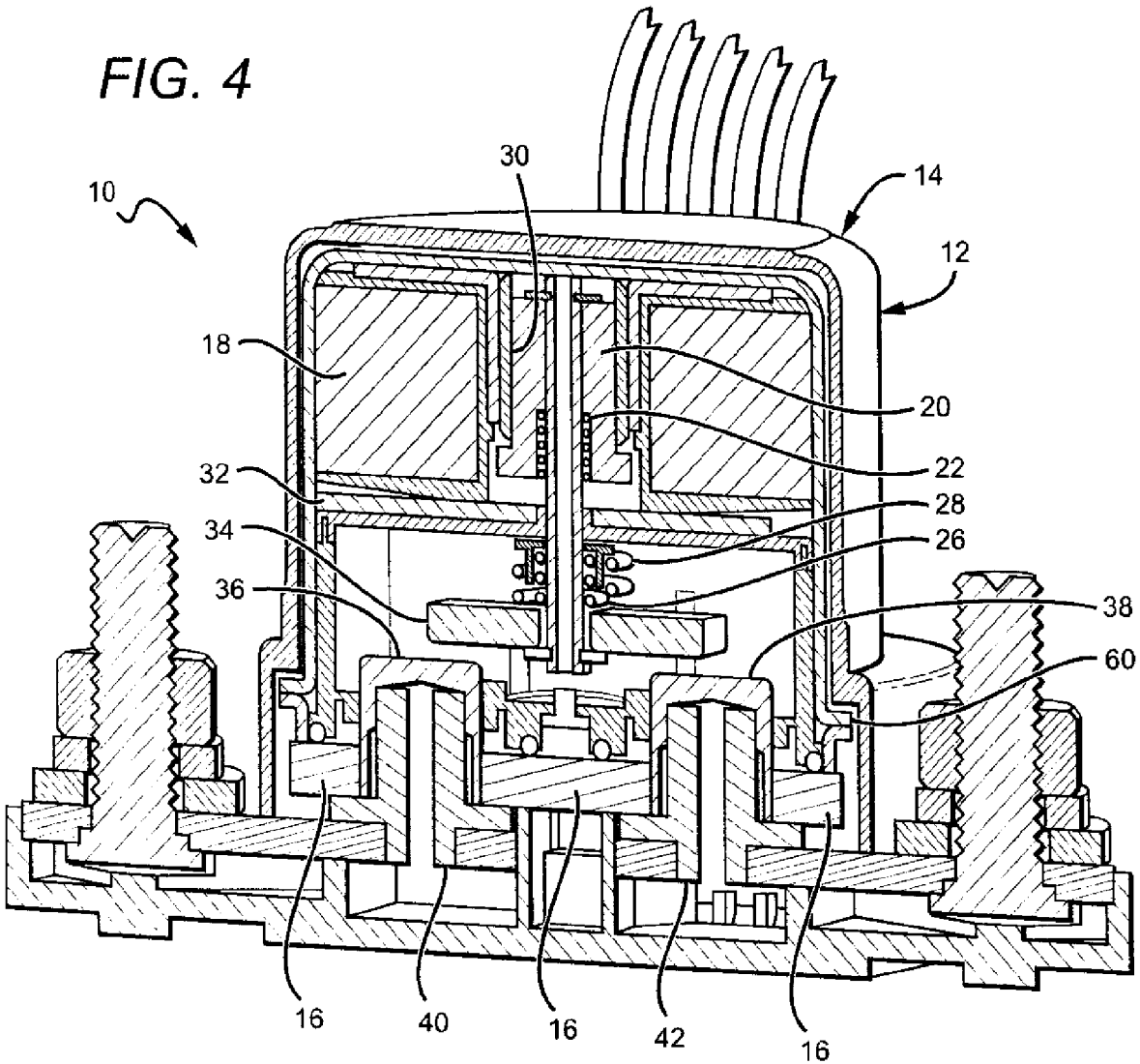
FIG. 4 is another sectional view of the contactor in FIG. 1.
Figure 5:
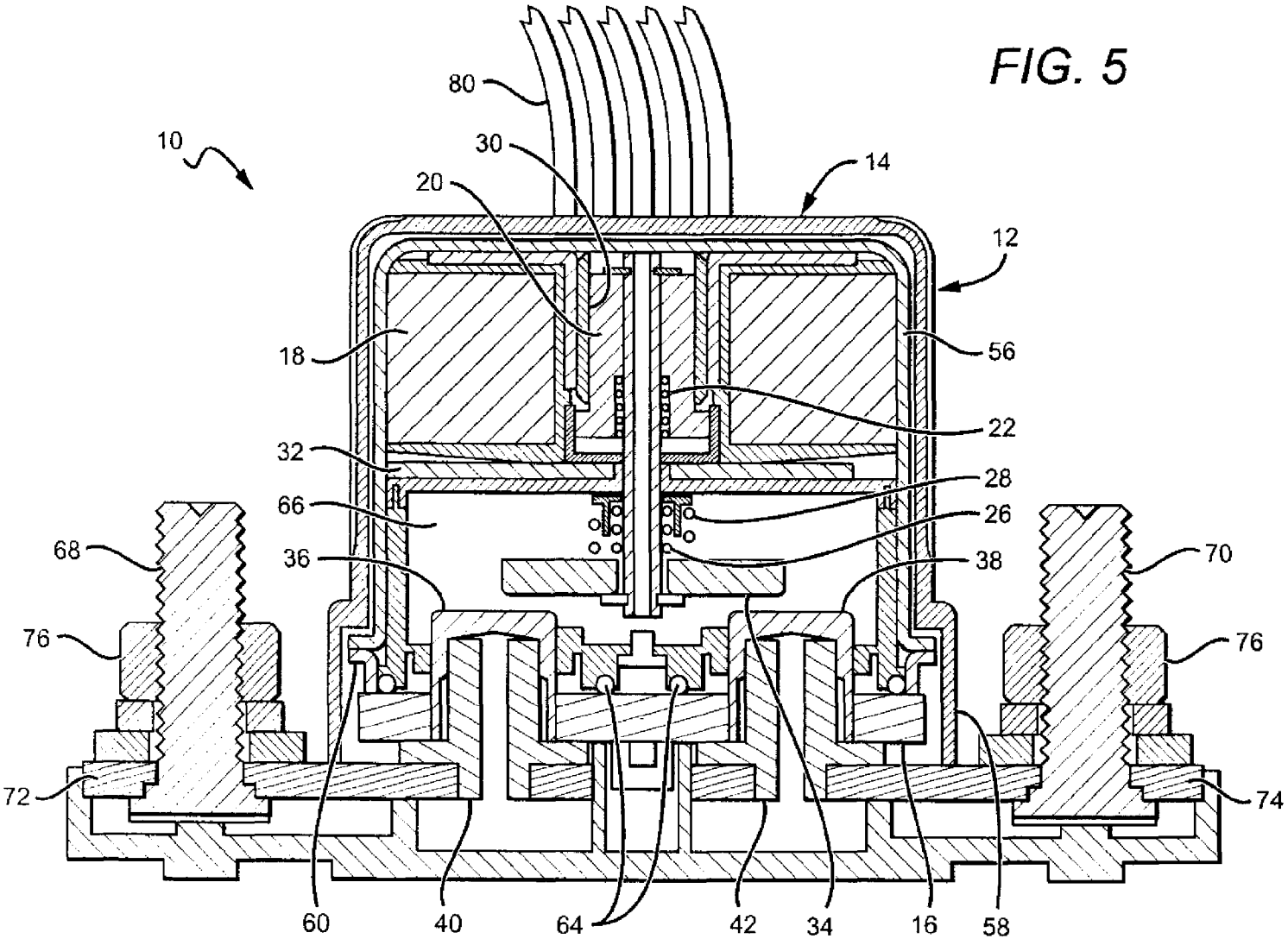
FIG. 5 is another sectional view of the contactor in FIG. 1.
Figure 6:
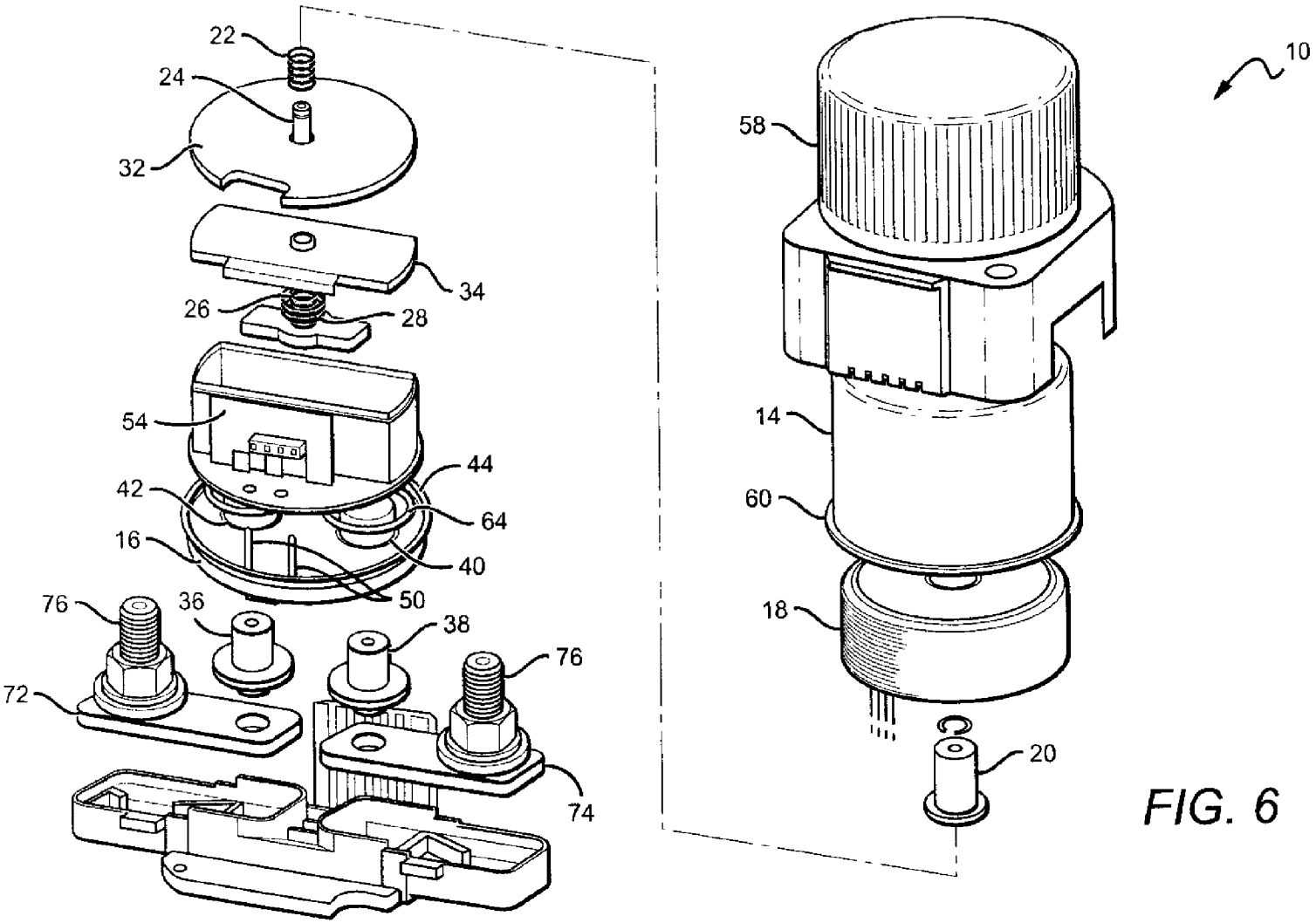
FIG. 6 is a perspective exploded view of the contactor in FIG. 1.
Figure 7:
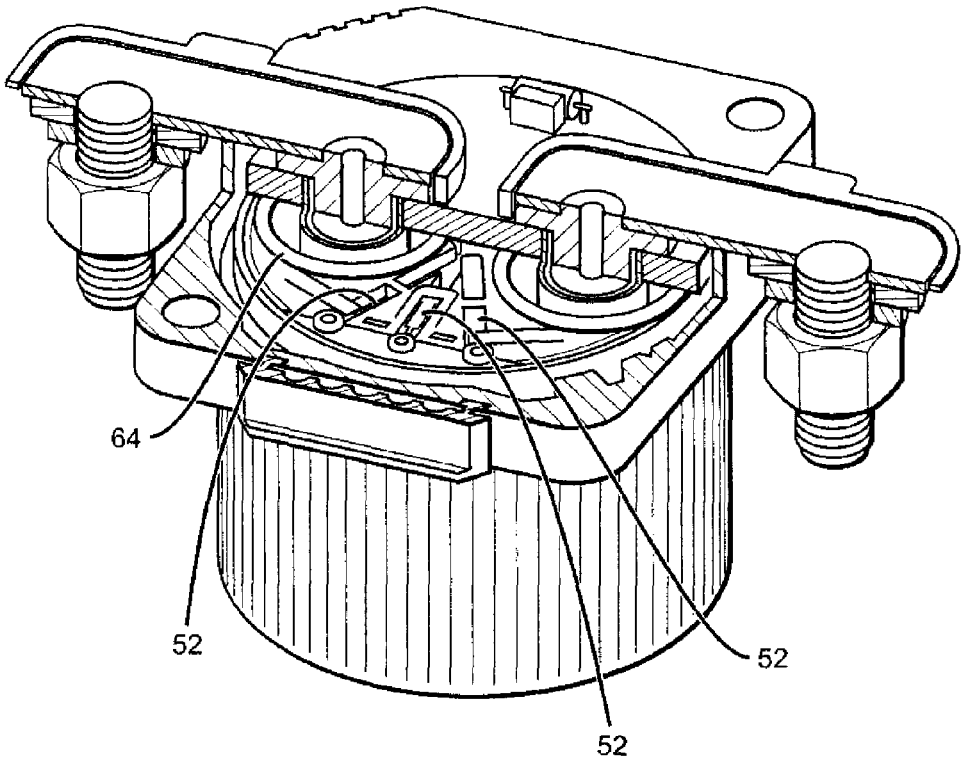
FIG. 7 is a sectional view of the bottom of the contactor in FIG. 1.

In one embodiment according to the present invention, these power reducing electronics are embodied in circuit board 54, which is located inside the hermetically sealed housing 12. Circuit board 54 utilizes electronic components that have been miniaturized so that it can be located inside the sealed portion of the contactor, which makes the circuit board 54 impervious to external environmental hazards. While there are many locations within the sealed housing 12 that circuit board 54 can be placed, FIG. 2 illustrates one embodiment.

Auxiliary contact plunger 78 is located between fixed contacts 40, 42, and is a means by which the contactor user can monitor the status of the contactor, and in particular the location of the plunger 20. One or more of the coil and auxiliary contact lead wires 80 can be connected to the auxiliary contact plunger 78. When the solenoid is activated and the plunger 20 and movable contact 34 move toward the fixed contacts 36, 38 the plunger activates the auxiliary contact plunger 78. This auxiliary contact plunger in turn generates a signal that is carried by one or more of the auxiliary contact lead wires, with this signal indicating that the plunger is in its extended position from the solenoid.

FIG. 11 shows another embodiment of a contactor 90 according to the present invention comprising a housing 82 having a cup 84 to hold the contactor's moving components and a header 110 to provide a hermetic seal. Similar to the contactor 10 described above with FIGS. 1-7, the contactor 90 comprises a solenoid 86 having a plunger 88 with a hollow shaft 92, a plunger spring 94, a first and second contact springs 96, 98, a moveable contact 100 and fixed contacts 102, 104. The terminal studs 106, 108, however, are located integrally to the header 110 and the housing 82 rather than to the left and right of said housing 82 as in FIGS. 1-7. It is understood that many more possible variations in location for the terminal studs are possible.

Although the present invention has been described in considerable detail with reference to certain preferred configurations thereof, other versions are possible. The contactor arrangement can have many different variations. The spirit and scope of the invention should not be limited to the preferred versions of the invention described above.

We claim:

1. A solenoid driven contactor, comprising:

a hermetically sealed housing having internal components for changing the state of said contactor, said housing comprising a cup for holding said internal components, and a ceramic header covering said cup with an airtight seal;

terminals electrically connected to said internal components for connection to circuitry and applying an electrical signal to control the state of said contactor;

a plunger movably operated by said solenoid, said plunger having a hollow shaft which allows gas within said sealed housing to flow freely through said plunger, wherein said hollow shaft comprises a hollow portion free from additional device components; and power-reducing electronics located inside said hermetically sealed housing.

2. A solenoid driven contactor, comprising:

a hermetically sealed housing having internal components for changing the state of said contactor, said housing comprising a cup for holding said internal components, and a ceramic header covering said cup with an airtight seal;

terminals electrically connected to said internal components for connection to circuitry and applying an electrical signal to control the state of said contactor; and a plunger movably operated by said solenoid, said plunger having a hollow shaft which allows gas within said sealed housing to flow freely through said plunger, wherein said hollow shaft comprises a hollow portion free from additional device components.

3. The contactor of claim 2, wherein said hollow shaft improves the movement and performance of said plunger.

4. The contactor of claim 2, wherein one of said internal components comprises a movable contact attached to said plunger, said movable contact moved by said solenoid.

5. The contactor of claim 4, wherein some of said internal components comprise stationary contacts, said movable contact and said stationary contacts creating a flow of current when they touch.

6. A high-powered contactor, comprising:

a hermetically sealed housing having internal components for changing the state of said contactor, said housing comprised of a cup and a ceramic header, said cup having an opening and holding said internal components, and said header covering said cup opening and mounted to said cup with an airtight seal to form said hermetically sealed housing;

terminals electrically connected to said internal components for connection to circuitry and applying an electrical signal to control the state of said contactor;

a plunger movably operated by said internal components, said plunger having a hollow shaft which allows gas within said sealed housing to flow freely through said plunger, wherein said hollow shaft comprises a hollow portion free from additional device components; and power-reducing electronics located inside said hermetically sealed housing.

7. The contactor of claim 6, wherein said internal components comprise a solenoid controlled by said electrical signal to change the state of said solenoid.

* * * * *